United States Patent [19]

Hergeth

[11] Patent Number: 4,878,287

[45] Date of Patent: Nov. 7, 1989

[54] PROCESS AND APPARATUS FOR POSITIONING A BALE HOOP PARTING DEVICE

[76] Inventor: Hubert A. Hergeth, Kockerellstraβe 3, 5100 Aachen, Fed. Rep. of Germany

[21] Appl. No.: 84,405

[22] Filed: Aug. 10, 1987

[30] Foreign Application Priority Data

Feb. 19, 1986 [DE] Fed. Rep. of Germany ..... 3605215

[51] Int. Cl.[4] ..... B23P 19/04

[52] U.S. Cl. ..... 29/564.3; 83/370

[58] Field of Search ..... 53/381 R, 492; 29/564.3, 33.52; 83/370, 909, 925 EB

[56] References Cited

U.S. PATENT DOCUMENTS

| | | | |
|---|---|---|---|
| 2,820,282 | 1/1958 | Schneider, Jr. | 83/909 |
| 3,513,522 | 5/1970 | Thomson | 83/909 |
| 4,328,609 | 5/1982 | Born | 83/909 |
| 4,348,801 | 9/1982 | Dumont et al. | 83/909 |
| 4,414,730 | 11/1983 | Ohmura et al. | 83/909 |

FOREIGN PATENT DOCUMENTS

| | | | |
|---|---|---|---|
| 1120302 | 7/1968 | United Kingdom | 83/370 |

*Primary Examiner*—Gil Weidenfeld
*Assistant Examiner*—Daniel W. Howell
*Attorney, Agent, or Firm*—Herbert Dubno

[57] ABSTRACT

A bale of fibrous material bundled by metal hoops is pressed against an elongated guide, with at least one sensor disposed at the guide for producing signals in response to the presence of metal, a parting device adapted to sever a hoop being displaceable along the guide, and a control system operatively connected to the parting device and receiving signals from the sensor and in response to analyses of the signals, positioning and triggering the parting device to sever a hoop.

11 Claims, 3 Drawing Sheets

PROCESS AND APPARATUS FOR POSITIONING A BALE HOOP PARTING DEVICE

FIELD OF THE INVENTION

This invention applies to machines for parting or severing the hoops on bales. The hoops mostly comprise metal wires or metal bands. The parting device, for example, shears, or a hacking device, is moved along the bale.

BACKGROUND OF THE INVENTION

Apparatus of this type usually have a metal sensor disposed upstream of the parting mechanism in the direction of movement of the bale. In a preferred embodiment the sensor is moved by the carriage on the parting device. If the sensor is actuated by impingement on metal, the parting mechanism is triggered after a brief delay.

However, that simple construction has defects. Two bands may be disposed directly one beside the other on the bale and are evaluated by the sensor as merely one actuation. This wrong evaluation results in the impacting blade parting only the first of the two bands. Shears cannot part either of the bands, since they are prevented from penetrating the bale by a second band.

Another disadvantage is found when changing over between bands and wires in bale packaging. Since a normal sensor is actuated when the metal is first detected, the parting mechanism is triggered at the start. If the triggering delay is so adjusted that bands are impinged upon in the center, values are not right for baling wires. The wires are impinged upon only by the edge of the impacting blade, resulting in increased wear on the blade, or the wires are not touched at all.

OBJECT OF THE INVENTION

It is therefore an object of the present invention to provide an improved apparatus and method by means of which the parting device can be suitably positioned when the hoops are to be severed.

SUMMARY OF THE INVENTION

According to the invention, the positioning of the parting device is done by measuring the width of a hoop, evaluating the measured width and positioning the parting device accordingly. A metal sensor of any known kind is used for measuring the width of the hoops, and the resulting signal is delivered to a control system. As the sensor moves past the hoops, the control system compares the sensor actuation time determined by the impingement on metal of the sensor with adjusted reference times for bands and wires. If the actuation time is shorter than a "band" reference time, the control system selects "wire time delay" for positioning the parting device, the parting operation being triggered when such time has expired. If the actuation time is longer than the "wire" reference time and shorter than a "double wire" reference time, the "band time delay" is selected, and after it expires the parting operation takes place in the center of the band. If the actuation time is longer than the "double band" reference time, a time delay is selected which triggers the parting device on the first band. When the parting operation has been completed, the carriage is shifted a short distance on to the second band by the control system and the parting operation is triggered again. In this way double bands can be reliably parted and the parting apparatus always correctly posiitioned whether with wires or bands.

These references and delay times must be adapted to the speed of travel of the carriage carrying the sensor. Of course, a path measurement can be made instead of measuring time. In that case, path lengths and travel times are compared instead of the actuation times described. Such a path measurement can, for example, be combined with the carriage drive. A path transmitter might be connected and coded and measuring signals delivered to the code system. Path measurement can also be performed by the counting of pulses as the carriage travels past a fixed point.

Another possible way of measuring wire, bound and double bound would be a combination of at least two sensors disposed one behind the other in the direction of travel of the sensors. Instead of the reference time, the simultaneous actuation of one, two or three sensors would be used to determine hoop width. In still another embodiment of measuring the hoop width, a row of sensors would be disposed at short intervals along the path of the carriage. The sensors are stationary and do not change their position. The bale is pressed against the row of sensors. In this way the sensors give the position and width of the hoops and the control system positions the displaceable parting device accordingly.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
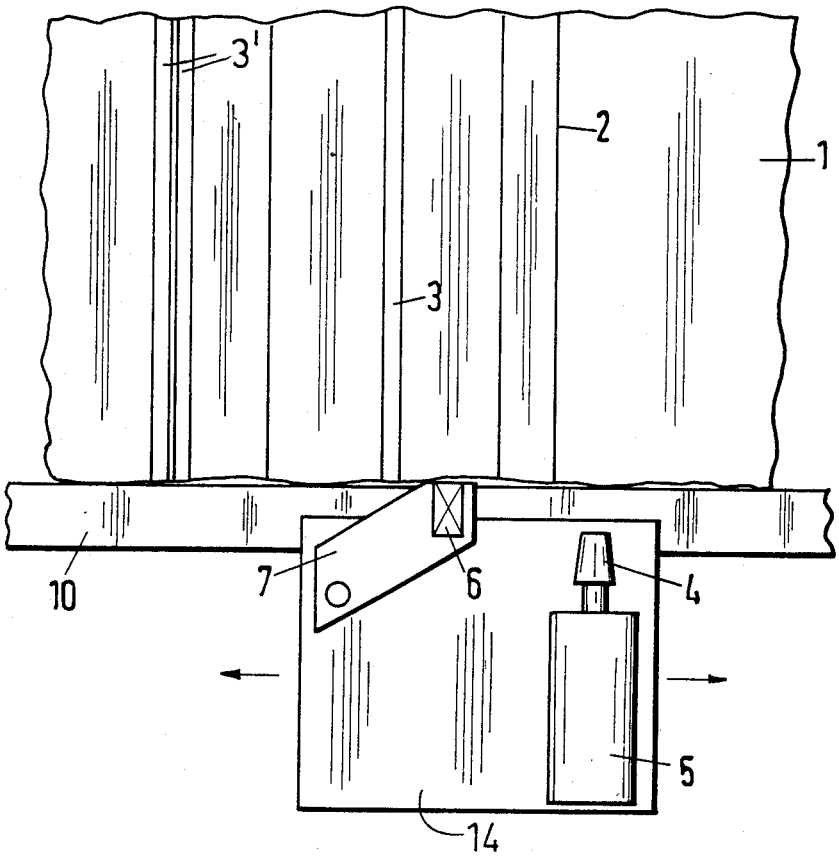
FIG. 1 is a somewhat diagrammatic top plan view of an apparatus according to the invention.

As illustrated in FIG. 1, a bale of fibrous material 1 is provided with hoops formed by a wire 2, a band 3 and double bands 3', as an example of the types of hoops which can be used.

The bale 1 is pressed against a guide 10 along which a carriage 14, carrying the sensor 6 and a parting chisel 4, is displaceable. The sensor 6 is mounted on a support 7 which urges the sensor against the bale in order to detect the hoops as the carriage is displaced. The chisel 4 is driven by a cylinder 5, the force of which acts to sever or part the hoops in response to detection by the sensor.

Figure 2:
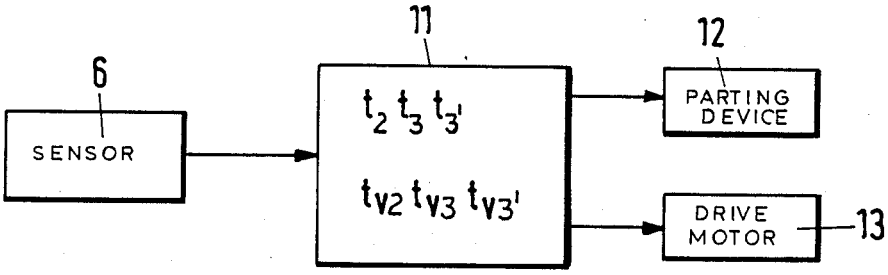
FIG. 2 is a block diagram of the control system of the apparatus of FIG. 1.

As illustrated in FIG. 2, the control system 11 receives signals having an actuation time from the sensor 6 which determine the delay times $t_{v2}$, $t_{v3}$ and $t_{v3}$, by comparison with the reference times $t_2$, $t_3$ and $t_3$, corresponding respectively with hoops 2, 3 and 3', which determines the moment when relays activate the parting device 12 formed by the chisel 4 and cylinder 5 and a drive motor 13 for the displacement of the carriage 14.

Figure 3:
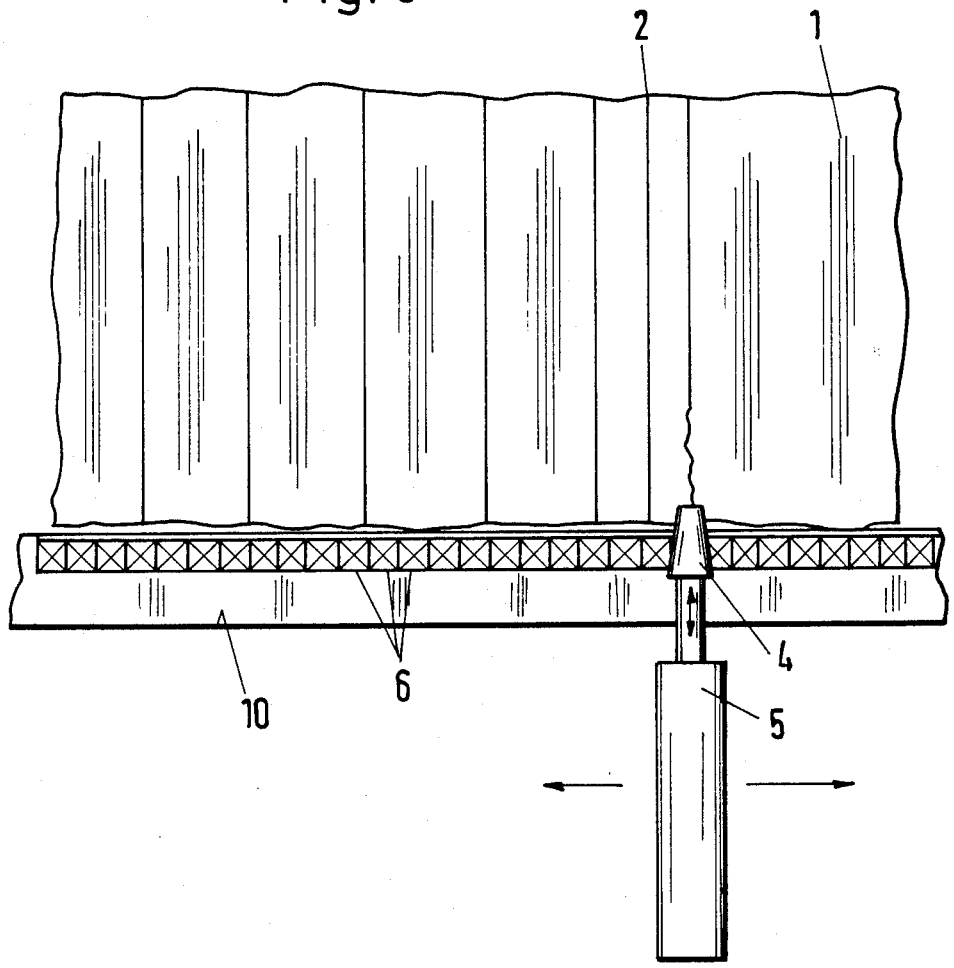
FIG. 3 is a top plan view similar to FIG. 1 of another embodiment of the invention.
Figure 4:
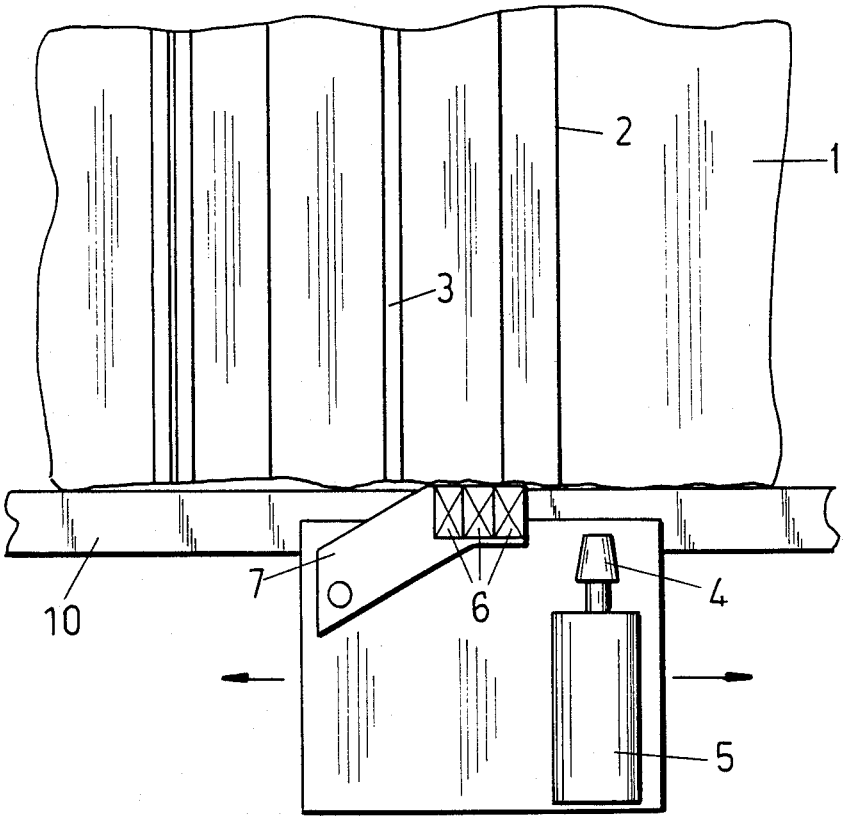
FIG. 4. is a view similar to FIG. 1 showing a plurality of sensors disposed at intervals along a guide.

FIG. 3 illustrates another embodiment of the invention in which the apparatus is provided with a row of stationary sensors 6 fixed at short intervals along the guide 10, and being so disposed, the sensors are able to detect the positions and widths of the hoops on the bale 1 pressed against the guide, the control system 11 positioning the chisel 4 and cylinder 5 accordingly. In FIG. 4 three sensors 6 are shown to be displaceable in the manner of the single sensor of FIG. 1.

I claim:

1. An apparatus for positioning and triggering a parting device for severing hoops on bales of fiber, the apparatus comprising:

an elongated guide against which a bale of fibrous material bundled by metal hoops is pressed;

at least one sensor disposed at said guide for producing signals in response to the presence of metal;

a parting device adapted to sever a hoop and displaceable along said guide; and a control system operatively connected to said parting device and receiving said signals from said sensor and in response to analyses of said signals, positioning and triggering said parting device to sever a hoop, the analyses of said control system including a comparison of the sensor actuation time with reference times representing hoops formed by a wire, a band and a double band, for determining the positioning and triggering of said parting device in accordance with the type of hoop to be severed.

2. The apparatus defined in claim 1 wherein said sensor is displaceable with said parting device and adapted to bear against said bale.

3. The apparatus defined in claim 1 wherein a plurality of said sensors are disposed at intervals along said guide.

4. The apparatus defined in claim 1 wherein said parting device includes a chisel driven by a cylinder.

5. A method of positioning and triggering a parting device for severing hoops on bales of fiber comprising the steps of:

(a) pressing a bale of fibrous material bundled by metal hoops against an elongated guide;

(b) providing at least one sensor at said guide for producing signals in response to the presence of metal;

(c) displacing a parting device adapted to sever a loop along said guide;

(d) operatively connecting a control system to said parting device and feeding said signals from said sensor to said control system; and (e) analysing said signals for determining the width of a hoop and thereby positioning and triggering said parting device for severing said hoop.

6. The method defined in claim 5 wherein the step of analyzing the signals includes comparing the signal actuation time from said sensor with reference times representing hoops formed by a wire, a band and a double band for determining the type of hoop to be severed.

7. The method defined in claim 6 further comprising the step of displacing said sensor along said guide.

8. The method defined in claim 5 further comprising the steps of:

displacing said sensor along said guide; and determining the width of a hoop by measuring the length of the path travelled by said sensor during activation thereof.

9. The method defined in claim 5, further comprising the steps of:

moving along said bale a plurality of sensors disposed at intervals along said guide; and determining the width of a hoop by the number of said sensors simultaneously activated by metal of said hoop.

10. The method defined in claim 5, further comprising the steps of:

disposing a plurality of sensors at intervals along said guide; and determining the width of a hoop by the number of sensors simultaneously activated by metal of said hoop.

11. The method defined in claim 6 further comprising the step of displacing said parting device by substantially half a band width when a first band of a double band hoop has been severed, said parting device again being triggered to sever the second band.

* * * * *